US006183291B1

(12) United States Patent
Watanabe et al.

(10) Patent No.: US 6,183,291 B1
(45) Date of Patent: Feb. 6, 2001

(54) ELECTRICAL CONNECTOR ASSEMBLY

(75) Inventors: Satoru Watanabe, Tokyo; Hidenori Muramatsu, Kanagawa, both of (JP)

(73) Assignee: The Whitaker Corporation, Wilmington, DE (US)

( * ) Notice: Under 35 U.S.C. 154(b), the term of this patent shall be extended for 0 days.

(21) Appl. No.: 09/424,371

(22) PCT Filed: May 19, 1998

(86) PCT No.: PCT/US98/10196

§ 371 Date: Nov. 23, 1999

§ 102(e) Date: Nov. 23, 1999

(87) PCT Pub. No.: WO98/53532

PCT Pub. Date: Nov. 26, 1998

(30) Foreign Application Priority Data

May 23, 1997 (JP) ..... 9-150005

(51) Int. Cl.[7] ..... H01R 12/24
(52) U.S. Cl. ..... 439/495
(58) Field of Search ..... 439/495, 496, 439/492, 493, 494, 497, 498, 499, 159, 160

(56) References Cited

U.S. PATENT DOCUMENTS 3,149,897 * 9/1964 Martineck ..... 439/495
3,897,130 * 7/1975 Donnelly et al. ..... 439/495
5,354,214 * 10/1994 Aso et al. ..... 439/492
5,474,468 * 12/1995 Chishima et al. ..... 439/495
5,562,487 * 10/1996 Ii et al. ..... 439/495
5,639,260 * 6/1997 McHugh ..... 439/495
5,688,143 * 11/1997 McHugh et al. ..... 439/495
5,690,510 * 11/1997 Chishima ..... 439/496
5,967,831 * 10/1999 Yamada et al. ..... 439/496

* cited by examiner

*Primary Examiner*—Gary F. Paumen
*Assistant Examiner*—Ross Gushi

(57) ABSTRACT

The present invention provides an electrical connector assembly in which a slider member can be securely supported with respect to a housing, so that variation in the position of a flexible printed circuit when the slider member and the flexible printed circuit are inserted into a mating connector can be minimized. The electrical connector assembly (1) is equipped with a housing (18, 19) which has plural rows of electrical terminals (15) that protrude from a wall of the housing, a flexible printed circuit (20), both ends of which are connected to the terminals (15) of the housing, and which has a plurality of conductive paths formed on a surface thereof, a slider member (30), which is inserted between the ends of the flexible printed circuit (20), and which is inserted between rows of contacts **(83*a*, 83*b*) of a mating connector (80) together with the flexible printed circuit (20) so that the conductive paths are caused to electrically engage the rows of contacts, and supporting members (40), which are attached to the housing, and which regulate the movement of the slider member (30)** in directions other than the direction (A) of insertion into the mating connector.

7 Claims, 6 Drawing Sheets

1
50
16
17
13
40
44
46
13a
35b
36b
34a
34
34b
15
42
21
33
31
20
A
30
35a
36a
10

ELECTRICAL CONNECTOR ASSEMBLY

FIELD OF THE INVENTION

The present invention relates to an electrical connector assembly which is used to make connections with PC cards which accommodate memory cards or hard disk drives.

BACKGROUND

The electrical connector assembly shown in FIG. 8 is a conventional electrical connector assembly disclosed in Japanese Patent Application No. 8-264240. Electrical connector assembly 100 is equipped with a housing 107 comprising an upper housing 101 and lower housing 102, the upper and lower housings 101, 102 are fastened together by metal plates 105, 106, plural rows of electrical terminals 103, 104 protrude from respective wall surfaces 101*a,* 102*a* of the upper housing 101 and lower housing 102, a flexible printed circuit 110, the ends of which are electrically connected to the respective terminals 103, 104, and which has numerous conductive paths 111 on a surface thereof, and a slider member 120 which is inserted between the ends of the flexible printed circuit 110 that is bent into a U-shape and connected to the terminals 103, 104.

Meanwhile, a mating connector 130, which is engaged with the electrical connector assembly 100, comprises a housing 131 having a recess 132 that accommodates the flexible printed circuit 110 of the electrical connector assembly 100 together with the slider member 120, and a plurality of electrical contacts 133, which are disposed inside the recess 132 of the housing 131, and which electrically engage the conductive paths 111 of the flexible printed circuit 110.

The slider 120 is equipped with an insertion member 121, which is inserted between the ends of the flexible printed circuit 110, and operating members 122, which are formed substantially perpendicular to the insertion member 121 and which have substantially flat planes. In order to cause the conductive paths 111 of the flexible printed circuit 110 to engage the contacts 133, housing 107 is held and the flexible printed circuit 110 is inserted into the recess 132, after which the operating members 122 of the slider member 120 are moved downward so that electrical engagement is achieved between conductive paths 111 and electrical contacts 133.

However, in electrical connector assembly 100, the slider member 120 is merely passed through the flexible printed circuit 110, both ends of which are attached to the wall surfaces 101*a,* 102*a* of the housing 107, and it is not supported with respect to the housing 107 by members other than the flexible printed circuit 110. As a result, the slider member 120 can also move in directions other than the direction of insertion into the mating connector 130, and it is therefore unstable. Consequently, the following problem arises: i. e., when the flexible printed circuit 110 is inserted into the recess 1332 of the mating connector 130, the flexible printed circuit 110 is unstable, and therefore varies in position within mating connector 130 thereby affecting the electrical connections between conductive paths 111 and electrical contacts 133.

SUMMARY

European Patent Application EP-A-0720254 shows another flexible printed circuit connector which utilizes a spacer plate. This connector is configured to provide flexible circuit connectors from one printed circuit board to a second printed circuit board. Another design is shown in U.S. Pat. No. 5,205,750. In this connector, a flexible printed circuit is secured to a circuit board and strengthened by a plate which is mounted between two brackets.

These designs, however, all have limitations which make their configurations undesirable for certain applications. Accordingly, the present invention provides an electrical connector assembly in which a slide member can be securely supported with respect to a housing, so that variation in the position of a flexible printed circuit when the slider member and the flexible printed circuit are inserted into a mating connector can be obviated.

The electrical connector assembly of the present invention comprises a housing which has plural rows of electrical terminals protruding from a wall, a flexible printed circuit both ends of which are connected to the electrical terminals of the housing and which has a plurality of conductive paths forced on a surface thereof, a slider member which is inserted between the ends of the flexible printed circuit, and is inserted together with the flexible printed circuit between rows of electrical contacts of a mating connector so that the conductive paths are caused to engage the electrical contacts, and supporting members are attached to the housing, which regulate the movement of the slider member in directions other than the direction of insertion into the mating connector.

Furthermore, it is desirable that rectangular openings, which extend in the direction of insertion into the mating connector, be provided in the supporting members, and that substantially L-shaped supporting sections, which are inserted into the rectangular openings, be located on the slider member.

Moreover, a much greater effect is obtained if each of the supporting members has an upper clamping member formed by being bent from an upper end of a base portion and a pair of lower clamping members formed by being bent from both sides of a lower end of the base portion, so that the clamping members clamp the housing from above and below, the lower clamping members are placed on a surface of an auxiliary circuit board, and the upper clamping member has a threaded section into which an attachment screw, which passes through the auxiliary circuit board, along the pair of lower clamping members and the housing, is received.

An electrical connector assembly for matable engagement with electrical contacts of a matable electrical connector comprises an electrical connector including a housing having electrical terminals extending outwardly from a wall thereof, a flexible printed circuit having conductive paths on a surface thereof and both ends electrically connected to respective electrical terminals, and a slide member is inserted between the flexible printed circuit, wherein supporting members are mounted onto the housing of the electrical connector, and supporting sections on the slider member are mounted to the supporting members so that the flexible printed circuit and the slider member can be inserted into the matable electrical connector with the conductive paths on the flexible printed circuit electrically engaging the electrical contacts of the matable electrical connector.

BRIEF DESCRIPTION OF THE DRAWING

An embodiment of the present invention will now be described by way of example with reference to the accompanying drawings in which.

DETAILED DESCRIPTION OF THE PREFERRED EMBODIMENT

Figure 1:
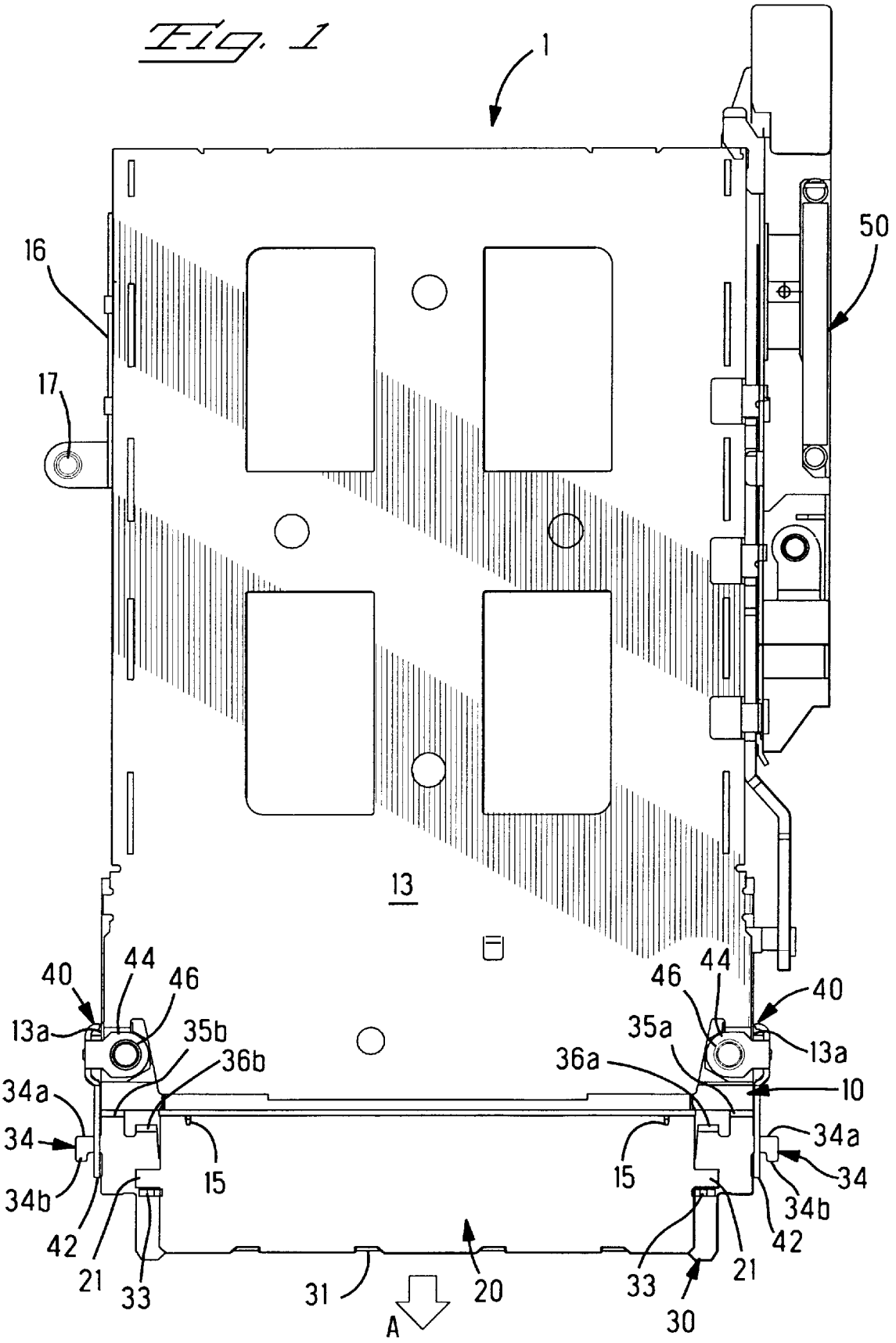
FIG. 1 is a plan view of an electrical connector assembly of the present invention.
Figure 2:
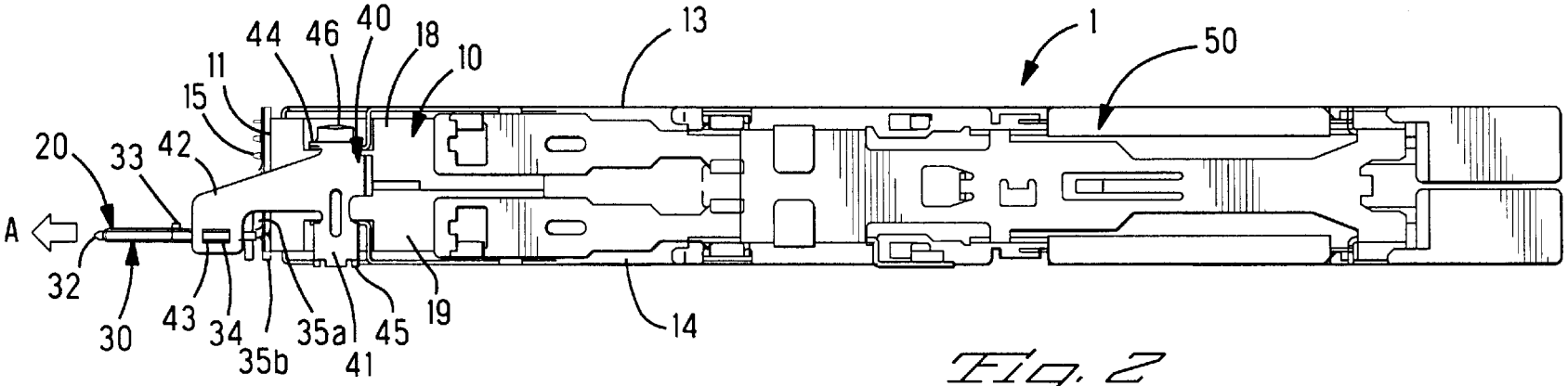
FIG. 2 is a right-side view of the electrical connector assembly shown in FIG. 1.
Figure 3:
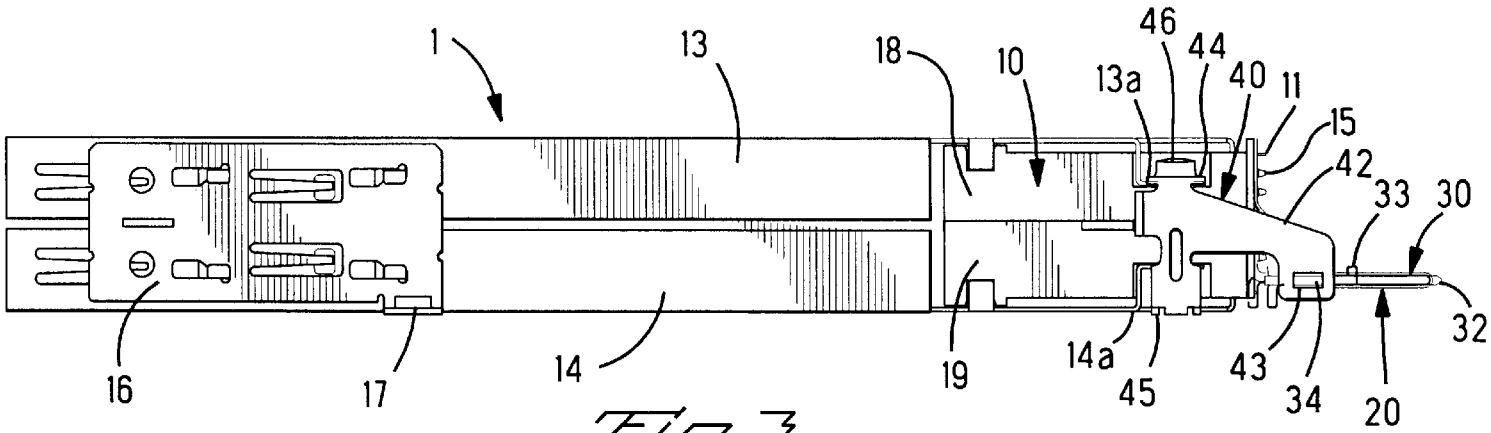
FIG. 3 is a left-side view of the electrical connector shown in FIG. 1.
Figures 4A, 4B, 4C:
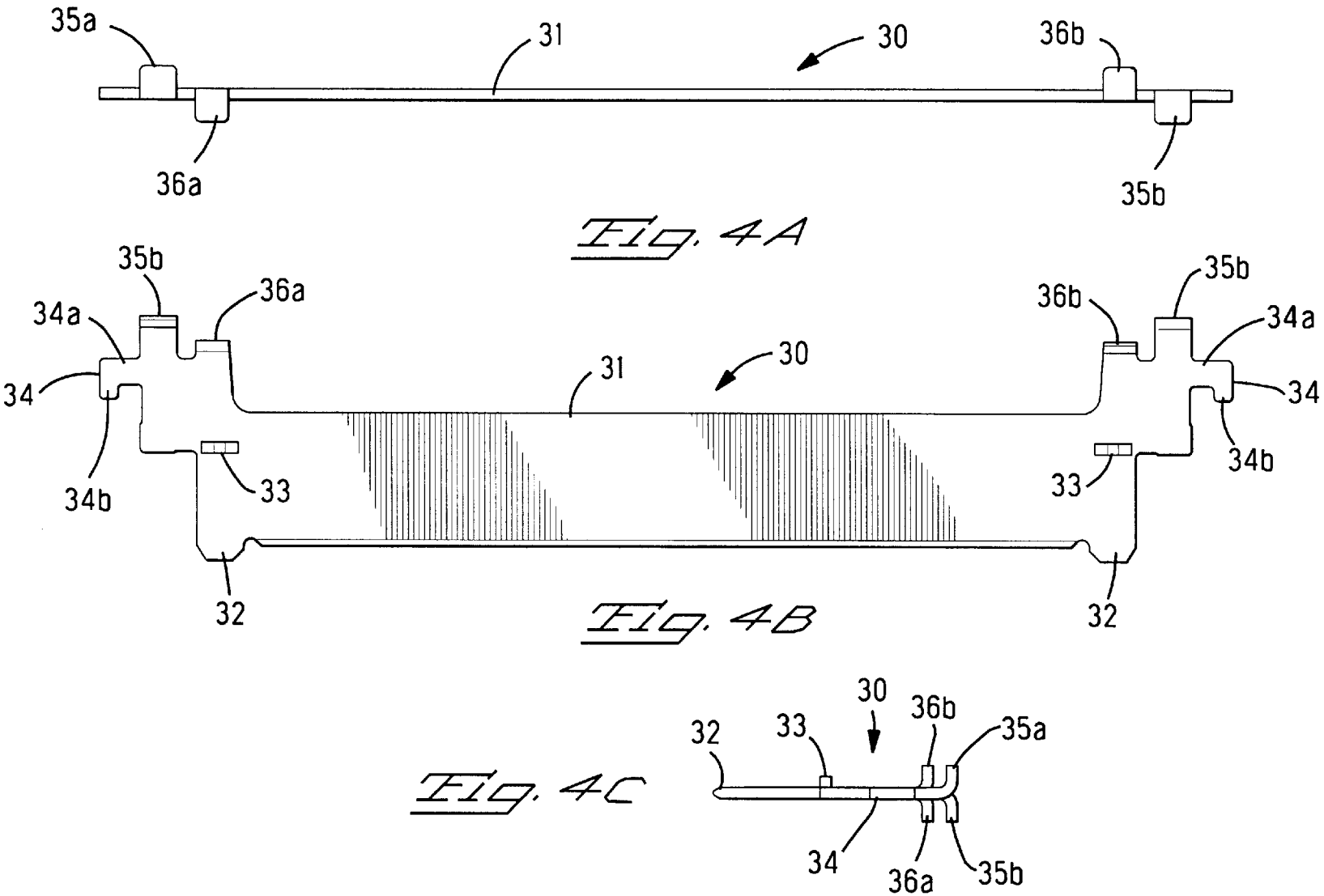
FIG. 4A is a front view of a slider member.
FIG. 4B is a bottom view of the slider member.
FIG. 4C is a left-side view of the slider member.

In FIGS. 1–3, electrical connector assembly 1 is equipped with a housing 10, which includes an upper housing 18 and a lower housing 19, plural rows of electrical terminals 15 protrude from respective rear walls 11 of the upper and lower housings 18, 19, a flexible printed circuit 20 both ends of which are connected to the terminals 15 of the housing 10, and which has a plurality of conductive paths (not shown) formed on a surface thereof, a slider member 30, is inserted between the ends of the flexible printed circuit 20 that are connected to the terminals 15 and is inserted between the rows of electrical contacts 83*a,* 83*b* of mating connector 80 (see FIG. 7) together with the flexible printed circuit 20 so that the conductive paths are caused to electrically engage the rows of contacts 83*a,* 83*b,* and a pair of supporting members 40 clamp onto the upper housing 18 and lower housing 19 from above and below, and which regulate the movement of the slider member 30 in directions other than the direction A of insertion into the mating connector 80.

An upper frame 13 and a lower frame 14 are formed by stamping and forming thin metal plates and are attached to the upper surface and bottom surface of the housing 10, and respective PC cards (not shown) are insertable into the upper frame 13 and lower frame 14. These PC cards are inserted from the rear ends of the upper frame 13 and lower frame 14 (i. e., the upper end of FIG. 1), and are electrically connected to the terminals 15 disposed in the upper housing 18 and lower housing 19. A card-ejection mechanism 50, which is used to eject PC cards that have been inserted into the upper frame 13 and lower frame 14 and connected to the terminals 15, is mounted on one side surface of the upper frame 13 and lower frame 14.

As shown in FIGS. 1 through 4C, the slider member 30 is formed by stamping and forming a metal plate. Slider member 30 has flat plate section 31 along which the flexible printed circuit 20 extends, and substantially L-shaped supporting sections 34 having projecting members 34*a* that extend outward from both ends of the flat plate section 31 and release-preventing members 34*b* that extend forward (downward in FIG. 1) from the projecting members 34*a*. Furthermore, a pair of stop members 32, which extend forward, protrude from a front side of the flat plate section 31 at both ends thereof. The stop members 32 engage a bottom surface of a flexible printed circuit accommodating opening 82 in housing 81 of mating connector 80 when the slider member 30 is inserted between the rows of contacts 83*a,* 83*b* of the mating connector 80, and thus function as stop members for the slider member 30. Meanwhile, a pair of engaging members 35*a,* 35*b,* which engage the wall 11 (see FIG. 2) of the housing 10 at the time of insertion of the flexible printed circuit between the rows of contacts of the mating connector 80, are formed by being bent vertically in opposite directions at both ends of a rear side of the flat plate section 31. Since the engaging members 35*a,* 35*b* are formed by being bent vertically in opposite directions, there is no rotation of the slider member 30 when the respective engaging members 35*a,* 35*b* engage housing 10.

Furthermore, auxiliary engaging members 36*a,* 36*b,* which provide assistance when the respective engaging members 35*a,* 35*b* engage housing 10, are formed by being bent vertically in opposite directions at points located to the inside of the respective engaging members 35*a,* 35*b*. Additional engaging members 33, which engage projections 21 (see FIG. 1) of the flexible printed circuit 20 when the slider member 30 is pulled out from between the rows of contacts of the mating connector 80, are formed from flat plate section 31 so that the engaging members 33 protrude upward on both sides of roughly the central portion of the slider member 30 with respect to the front-rear direction. As a result of the formation of additional engaging members 33, no load is applied to the end portions of the flexible printed circuit 20 connected to the terminals 15 when the slider member 30 is pulled out of the mating connector 80.

Figure 5A:
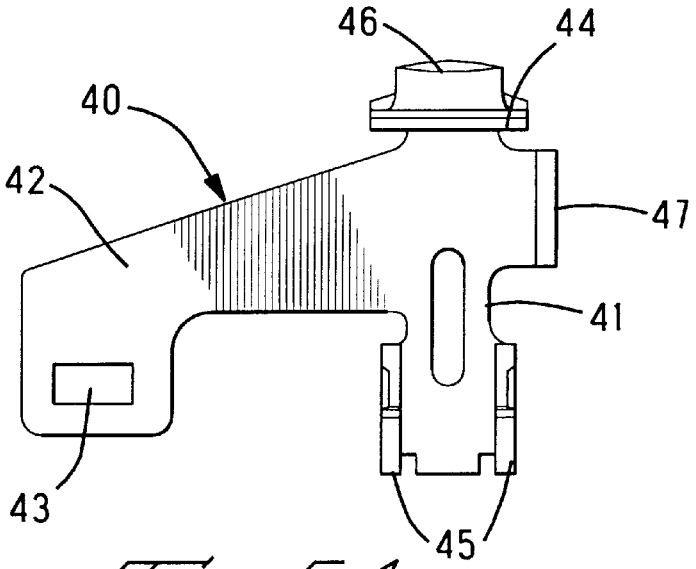
FIG. 5A is a front view of a supporting member.
Figure 5B:
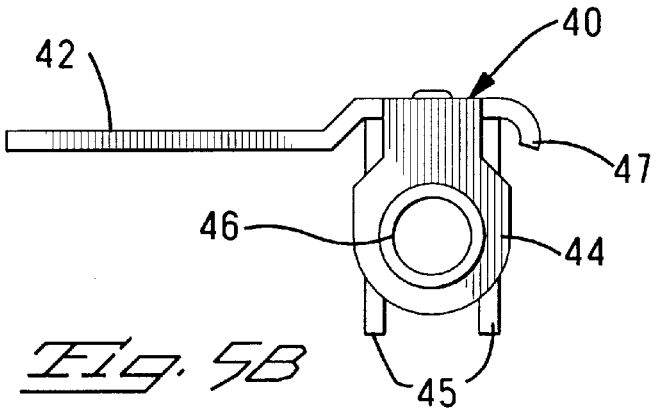
FIG. 5B is a plan view of the supporting member.
Figure 5C:
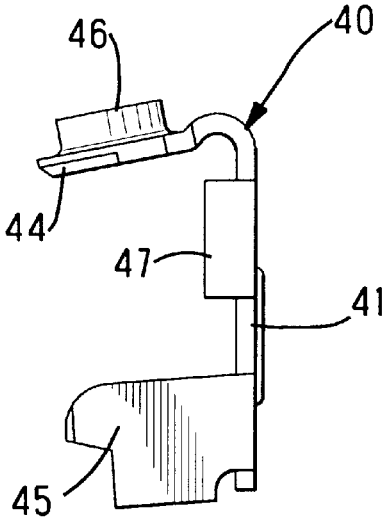
FIG. 5C is a right-side view of the supporting member.

FIGS. 5A–5C show the supporting member 40 on the left side in FIG. 1. The supporting member 40 on the right side in FIG. 1 has a structure which is symmetrical with the structure of the supporting member 40 on the left side shown in FIG. 1; accordingly, a description of this supporting member is omitted.

In FIGS. 1 through 5C, the supporting member 40 is formed by stamping and forming a metal plate. A supporting portion 42 extends forward from a base portion 41 and has a rectangular opening 43 at a front end, which extends in a direction A of insertion into the mating connector 80 (see FIG. 2). The corresponding substantially L-shaped supporting section 34 on the slider member 30 is inserted into rectangular opening 43. When the supporting section 34 is inserted into the rectangular opening 43, the projecting member 34*a* thereof passes between the upper and lower walls of the rectangular opening 43 as shown in FIG. 2; as a result, the movement of the slider member 30 in the vertical direction is regulated. Accordingly, the flexible printed circuit 20 into which the slider member 30 is inserted has no variation in position, and the insertion of flexible printed circuit 20 between the rows of contacts of the mating connector 80 is facilitated. Furthermore, when the supporting section 34 is inserted into the rectangular opening 43, the release-preventing member 34*b* is positioned to the outside of the supporting portion 42 as shown in FIG. 1; as a result, the release of the slider member 30 from the supporting member 40 during the insertion of the slider member 30 into the mating connector 80 is reliably prevented. Furthermore, the supporting member 40 has an upper clamping member 44 formed by being bent inward (i. e., toward the right in FIG. 1) from an upper end of the base portion 41, and a pair of lower clamping members 45 formed by being bent inward from both sides of a lower end of the base portion 41, so that the clamping members 44, 45 clamp the upper housing 18 and lower housing 19 together from above and below.

Figure 6:
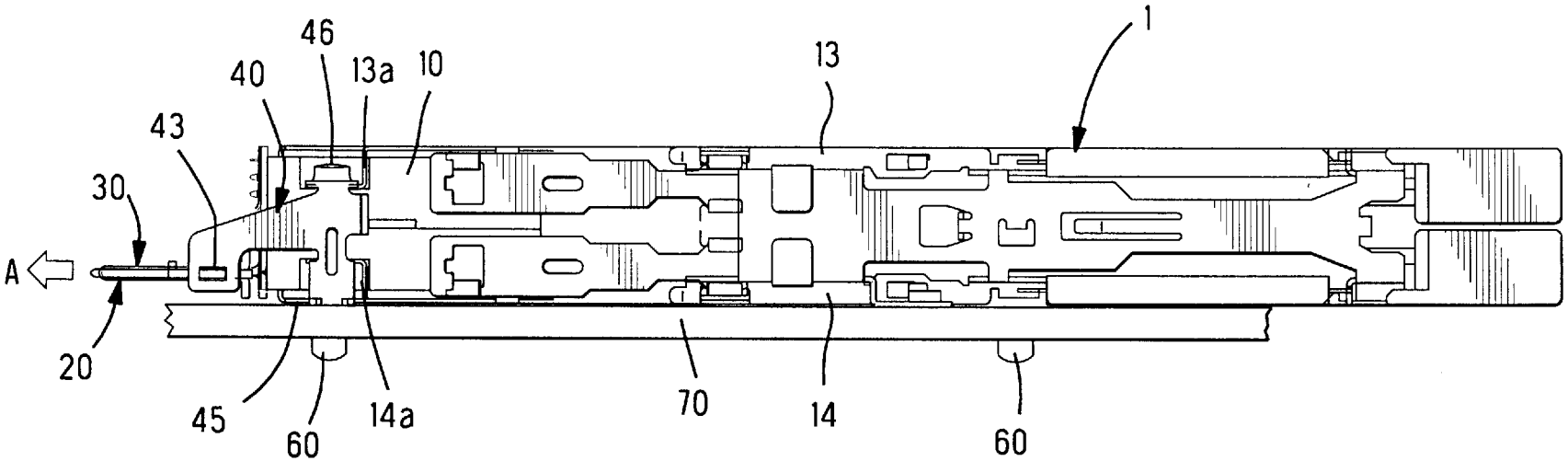
FIG. 6 is a right-side view which shows the electrical connector assembly shown in FIG. 1 fastened to a surface of an auxiliary circuit board.

An attachment plate member 13*a,* which is formed by being bent from the upper frame 13, is inserted between the upper clamping member 44 and the upper housing 18, and an attachment plate member 14*a,* which is formed by being bent from the lower frame 14, is inserted between the lower clamping members 45 and the lower housing 19. In this state, the supporting member 40 is attached to the housing 10. As shown in FIG. 6, the lower clamping members 45 are positioned on the auxiliary circuit board 70, and a threaded section 46 is formed in the upper clamping member 44. An attachment screw 60, which passes through the auxiliary circuit board 70, between the pair of lower clamping members 45, through the attachment plate member 14*a* of the lower frame 14, through the lower housing 19, upper housing 18 and attachment plate member 13*a* of the upper frame 13, is screwed into threaded section 46.

Furthermore, as shown in FIGS. 1, 3, attachment brackets 16 are also disposed on the side walls of the upper frame 13 and lower frame 14, and an attachment screw (not shown), which passes through the auxiliary circuit board 70, is screwed into a threaded section 17 of attachment brackets 16. In this way, the electrical connector assembly 1 is fastened to the auxiliary circuit board 70.

In FIGS. 5A–5C, a stop member 47, which is formed by being bent inward from the base portion 41 engages a side wall of the housing 10 when the supporting member 40 is attached to the housing 10.

Figure 7:
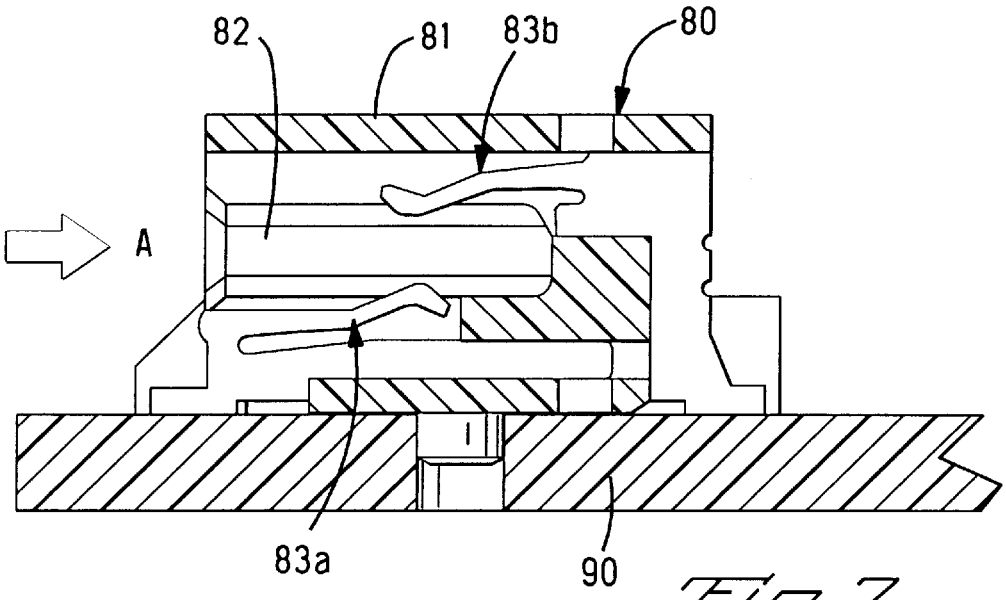
FIG. 7 is a cross-sectional view showing a mating connector fastened to a surface of a main circuit board.
Figure 8:
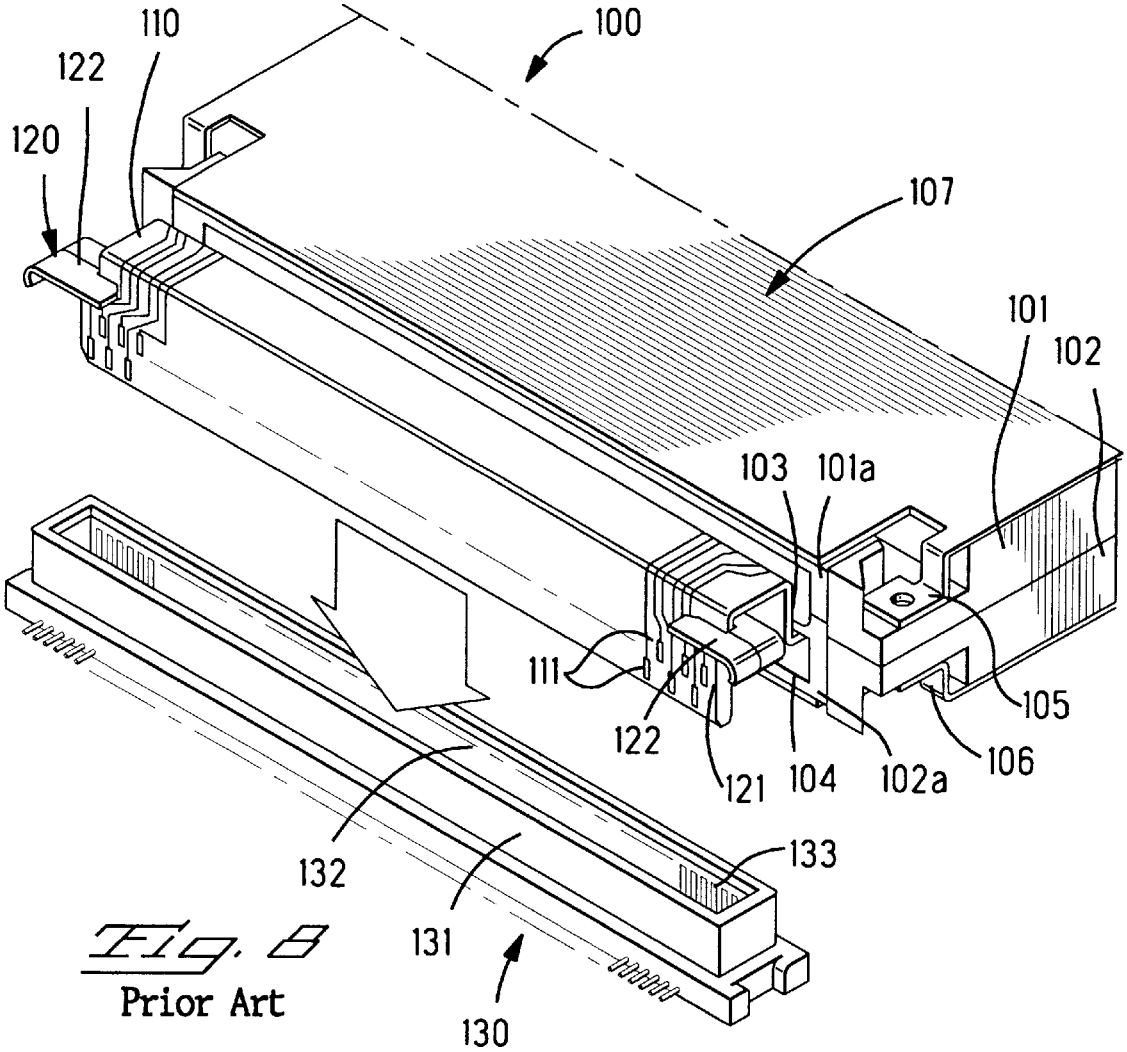
Fig. 8 Prior Art
FIG. 8 is a perspective view showing a conventional electrical connector assembly prior to engagement with a mating connector.

In FIG. 7, the mating connector 80 is equipped with a housing 81, which has a flexible printed circuit accommodating opening 82 that accommodates the slider member 30 and the flexible printed circuit 20, and electrical contact pairs of first contacts 83*a* and second contacts 83*b* that are installed along the direction of length of the housing 81 electrically engage the respective conductive paths of the flexible printed circuit. Mating connector 80 is fastened to a surface of a main circuit board 90. Furthermore, the direction A of insertion of the slider member 30 is parallel to the main circuit board 90; however, it is not necessary that this direction be parallel to the main circuit board 90.

When the slider member 30 of the electrical connector assembly 1 (shown in FIG. 6) that is fastened to the surface of the auxiliary circuit board 70 is inserted between the rows of contacts 83*a*, 83*b* of the mating connector 80 together with the flexible printed circuit 20, the conductive paths formed on the flexible printed circuit 20 electrically engage the respective contacts 83*a*, 83*b*, and when the slider member 30 is pulled out from between the rows of contacts 83*a*, 83*b* of the mating connector 80 together with the flexible printed circuit 20, the engagement between the conductive paths and the contacts 83*a*, 83*b* is broken.

In the electrical connector assembly of the present invention, supporting members are attached to the housing and regulate the movement of a slider member in directions other than the direction of insertion into the mating connector. Accordingly, the slider member is securely supported with respect to the housing, so that variation in the position of the flexible printed circuit when the slider member and flexible printed circuit are inserted into the mating connector can be minimized, thereby facilitating the insertion of the flexible printed circuit into the mating connector.

Furthermore, in the electrical connector assembly of the present invention, rectangular openings, which extend in the direction of insertion into the mating connector, are formed in the supporting members, and substantially L-shaped supporting sections, which are inserted into the rectangular openings, are formed on the slider member. Accordingly, the release of the slider member from the supporting members when the slider member is inserted into the mating connector can be reliably prevented.

Moreover, in the electrical connector assembly of the present invention, not only can the supporting members clamp onto the housing by means of an upper clamping member and a pair of lower clamping members, but attachment screws which are passed through the auxiliary circuit board, along lower clamping members and the housing, are screwed into threaded sections of the upper clamping members, so that the electrical connector assembly can be fastened to an auxiliary circuit board.

What is claimed is:

1. An electrical connector assembly for matable engagement with electrical contacts of a matable electrical connector, the assembly comprising an electrical connector (10) including a housing (18, 19) having electrical terminals (15) extending outwardly from a wall thereof, a flexible printed circuit (20) having conductive paths on a surface thereof and both ends electrically and physically connected to the respective electrical terminals (15), and a slider member (30) inserted between the ends of the flexible printed circuit, characterized in that:

supporting members (40) having rectangular openings (43) are mounted onto the housing (18, 19) of the is electrical connector (10), and supporting sections (34) of the slider member (30) having release-preventing members (34*b*) are mounted in the rectangular openings (43) such that projecting members (34*a*) are received within the rectangular openings (43) and the release-preventing members (34*b*) extend beyond and out of alignment with the rectangular openings (43), the flexible printed circuit and the slider member thereby being insertable into the matable electrical connector with the conductive paths on the flexible printed circuit electrically engaging the electrical contacts of the matable electrical connector.

2. An electrical connector assembly as claimed in claim 1, wherein said supporting sections (34) are L-shaped with the projecting members (34*a*) extending outwardly from both ends of a flat plate section (31) and the release-preventing members (34*b*) extending along outside surfaces of the supporting portions (42).

3. An electrical connector assembly as claimed in claim 1, wherein the housing (18, 19) comprises an upper housing (18) and a lower housing (19).

4. An electrical connector assembly as claimed in claim 3, wherein said supporting members (40) include upper clamping members (44) engaging the upper housing (18) and lower clamping members (45) engaging the lower housing (19).

5. An electrical connector assembly as claimed in claim 1, wherein the slider member (30) includes engaging members (35*a*, 35*b*) for engaging the housing (18, 19).

6. An electrical connector assembly as claimed in claim 5, wherein auxiliary engaging members (36*a*, 36*b*) are provided on the slider members adjacent the engaging members (35*a*, 35*b*).

7. An electrical connector assembly as claimed in claim 6, wherein additional engaging members (33) are provided on the slider member (30) for engagement by projections (21) of the flexible printed circuit (20).

* * * * *